US005789636A

United States Patent [19]

Holighaus et al.

[11] Patent Number: 5,789,636

[45] Date of Patent: Aug. 4, 1998

[54] PROCESS FOR RECOVERING SYNTHETIC RAW MATERIALS AND FUEL COMPONENTS FROM USED OR WASTE PLASTICS

[75] Inventors: Rolf Holighaus, Haltern; Klaus Niemann, Oberhausen; Claus Strecker, Gelsenkirchen, all of Germany

[73] Assignee: Veba Oel AG, Gelsenkirchen, Germany

[21] Appl. No.: 809,711

[22] PCT Filed: Oct. 2, 1995

[86] PCT No.: PCT/EP95/03901

§ 371 Date: Aug. 15, 1997

§ 102(e) Date: Aug. 15, 1997

[87] PCT Pub. No.: WO96/10619

PCT Pub. Date: Apr. 11, 1996

[30] Foreign Application Priority Data

Oct. 4, 1994 [DE] Germany ..... 44 35 238.7

[51] Int. Cl.[6] ..... C10G 1/10; C10B 55/00

[52] U.S. Cl. ..... 585/241; 585/240; 208/400; 201/13; 201/14; 201/15; 201/21; 201/22; 201/23; 201/24; 201/25

[58] Field of Search ..... 585/240, 241; 208/400, 39; 201/13, 14, 15, 21, 22, 23, 24, 25

[56] References Cited

U.S. PATENT DOCUMENTS

| | | | |
|---|---|---|---|
| 4,243,488 | 1/1981 | Sugimura et al. | 201/6 |
| 5,061,363 | 10/1991 | Farcasiu et al. | 208/419 |
| 5,364,996 | 11/1994 | Castagnoli et al. | 585/241 |

FOREIGN PATENT DOCUMENTS 43 11 034 10/1994 Germany .

*Primary Examiner*—Bekir L. Yildirim
*Attorney, Agent, or Firm*—Oblon, Spivak, McClelland, Maier & Neustadt, P.C.

[57] ABSTRACT

The invention concerns a process for recovering synthetic raw materials and fluid fuel components from used or waste plastics in accordance with patent application P 43 11 034.7. At least a partial flow of the depolymer produced according to this process is subjected, together with coal, to a coking process, fed to a thermal utilization system or introduced as a reducing agent into a blast furnace process. The depolymer can be used as an additive for bitumen and bituminous products.

18 Claims, 6 Drawing Sheets

PROCESS FOR RECOVERING SYNTHETIC RAW MATERIALS AND FUEL COMPONENTS FROM USED OR WASTE PLASTICS

BACKGROUND OF THE INVENTION

1. Field of the Invention

This application is on 371 of PLT/EP95/03901 filed on Oct. 2, 1995.

The invention concerns a method to obtain chemical raw materials and/or liquid fuel components from old or waste plastics and the use of a depolymerization product formed according to this method, in which the old or waste plastics are depolymerized at an elevated temperature, perhaps with the addition of a liquid auxiliary phase, a solvent, or a solvent mixture, with the gaseous and condensable depolymerization products (condensed product) and a sump phase (depolymerization product) formed, containing pumpable viscous depolymerization products, being removed in separate partial flows and with the condensed product and depolymerization product being worked up, separately from one another.

2. Description of the Background

Such a method is described in German Patent No. A-4, 311,034.

DETAILED DESCRIPTION OF THE PREFERRED EMBODIMENTS

The products of the depolymerization are essentially subdivided into three main product flows:

1) A depolymerization product in a quantity between 15 and 85 wt %, based on the plastic mixture used and which, depending on the composition and the individual requirements, can be subdivided into partial product, flows conducted to the sump-phase hydrogenation, elevated-pressure gasification, low-temperature carbonization (pyrolysis), and/or other processes and uses.

They are mostly heavy hydrocarbons that boil around >480° C. and all of which contain inert substances introduced into the process with the old and waste plastics, such as aluminum films, pigments, fillers, and glass fibers.

2) A condensed product in a quantity of 10 to 80 wt %, preferably 20 to 50 wt %, based on the plastic mixture used, which boils in a range between 25° C. and 520° C. and can contain up to approximately 1000 ppm of organically bound chlorine.

The condensed product can be converted into a high-quality, synthetic raw oil (Syncrude), for example, by hydrotreating on stationary commercial Co—Mo or Ni—Mo catalysts, or also can be directly introduced into chlorine-tolerating, chemical-technical, or common refinery methods as a hydrocarbon-containing base substance.

3) A gas in quantities of approximately 5 to 20 wt %, based on the used plastic mixture, which in addition to methane, ethane, propane, and butane can also contain gaseous hydrogen halides, such as mainly hydrogen chloride and readily volatile, chlorine-containing hydrocarbon compounds.

The hydrogen chloride can be scrubbed out, for example, with water from the gas flow to obtain a 30% aqueous hydrochloric acid solution. The residual gas can be freed of organically bound chlorine through hydrogenation in a sump-phase hydrogenation or in a hydrotreater and can be conducted, for example, to the refinery gas processing.

The method parameters are thereby selected in such a way that as high as possible a fraction of condensed product forms.

The individual product flows, in particular the condensed product, can be subsequently used in the course of its further processing in the sense of a raw-material recycling—for example, as raw materials for the olefin production in ethylene units.

Figure 6:
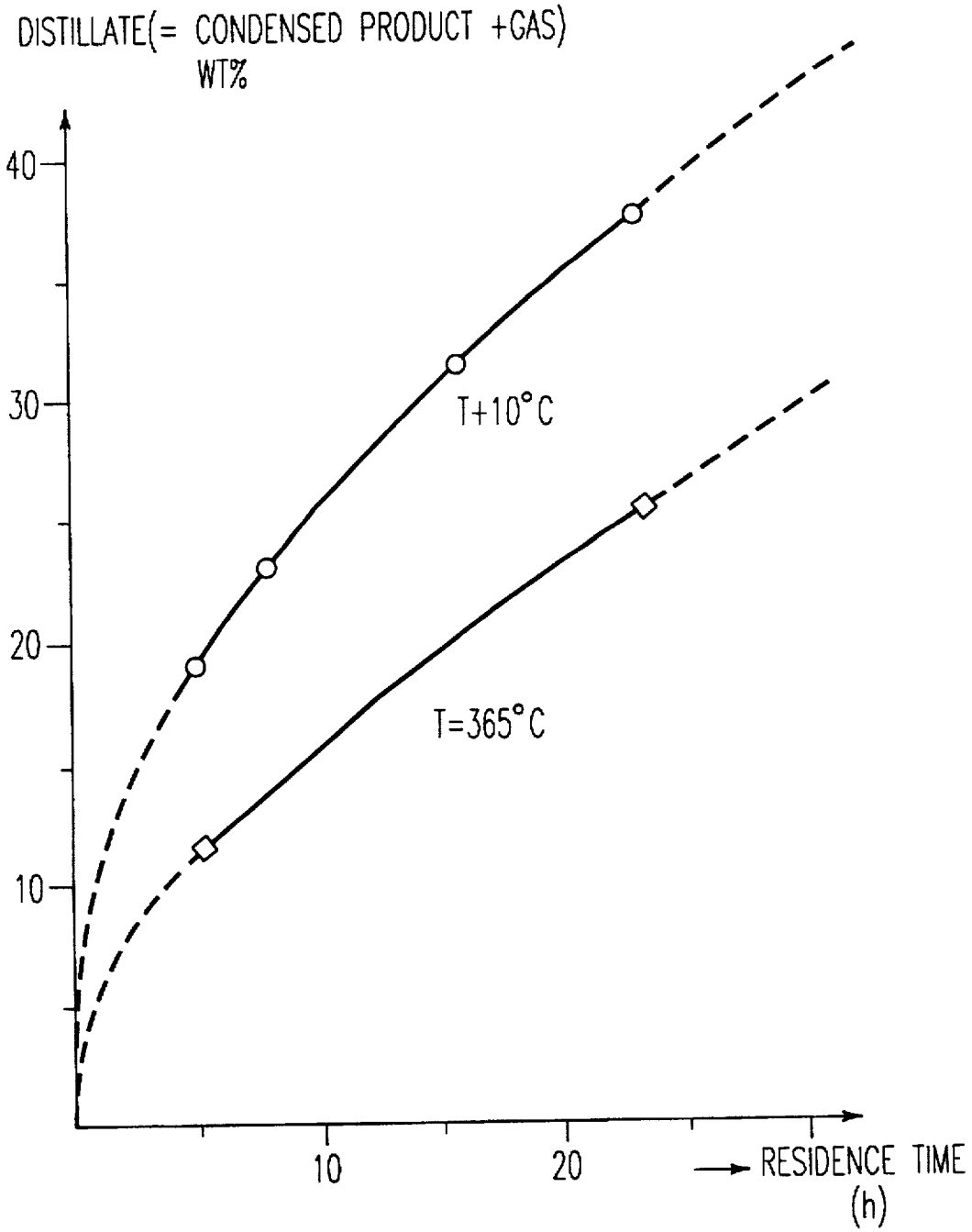
FIG. 6 provides a graphical representation of distillate content versus resident time.

An advantage of the method is to be found in the fact that inorganic secondary components of the old or waste plastics are concentrated in the sump phase, whereas the condensed product not containing these components can be further processed in less expensive methods. In particular, the optimal adjustment of the process parameters—temperature and residence time—makes it possible to form, on the one hand, a relatively high fraction of condensed product and, on the other hand, enables the viscous depolymerization product of the sump phase to remain pumpable under the process conditions. The fact that an increase in the temperature by 10° C., with an average residence time, increases the yield of products converted into the liquid phase by more than 50% can serve as a useful approximation. FIG. 6 shows the residence-time dependence for two typical temperatures.

The temperature range for the depolymerization preferred for the method is 150° to 470° C. A range of 250° to 450° C. is particularly suitable. The residence time can be 0.1 to 20 h. A range of 1 to 10 h has proved to be sufficient, in general. The pressure is a less critical parameter. Thus, it may be absolutely preferable that the method be carried out under reduced pressure—for example, if volatile components have to be withdrawn because of reasons related to the method. However, relatively high pressures are also practicable, but require a high apparatus outlay. In general, the pressure should be 0.01 to 300 bar, in particular 0.1 to 100 bar. The method can be advantageously carried out under normal pressure or slightly above it, for example, up to approximately 2 bar, which clearly reduces the apparatus outlay. In order to be able to degas the depolymerization product as completely as possible and in order to increase the condensed product fraction even more, the method is advantageously carried out under slightly reduced pressure down to approximately 0.2 bar.

The depolymerization can be carried out in a common reactor, for example, a stirred-vessel reactor, which is designed with the appropriate process parameters, such as pressure and temperature. Suitable reactors are described in the nonpublished German Patent Applications Nos. P 4,417, 721.6 and P 4,428,355.5. Preferably, the reactor contents are moved via a circulation system connected to the reactor for protection against overheating. In a preferred specific embodiment, this circulation system comprises a furnace/heat exchanger and a highly efficient pump. The advantage of this method lies in the fact that a high circulation flow via the external furnace/heat exchanger makes it possible that, on the one hand, the necessary temperature increase of the material in the circulation system remains small and, on the other hand, that favorable transmission conditions in the furnace/heat exchanger result in moderate wall temperatures. In this way, local overheating and thus uncontrolled decomposition and coke formation are extensively avoided. The heating of the reactor contents takes place in a manner that is very gentle by comparison.

A high circulation flow can be advantageously attained with highly efficient rotary pumps. Like other sensitive elements of the circulation system, however, these have the disadvantage that they are susceptible to erosion.

This can be counteracted in that the reactor contents withdrawn into the circulation system, before their entry into the system, go through an ascending sector integrated into the removal conduit, where coarser solid particles with a correspondingly high sedimentation rate are separated.

The reactor is designed in such a way that the removal device for the circulation (circulation system) lies in an ascending sector for the essentially liquid reactor contents. By a suitable specification of the ascending rate, essentially determined by the dimensioning of the ascending sector and the dimensioning of the circulation flow, particles with a higher sedimentation rate, which cause the erosion, can be kept from the circulation. The ascending sector within the reactor can be designed in the form of a tube, which is affixed essentially vertically in the reactor (see FIG. 1).

Figure 2:
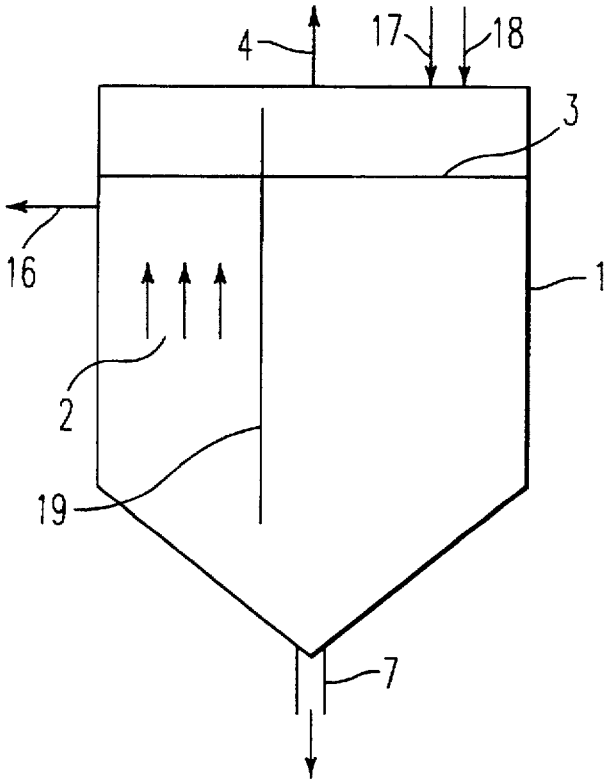
FIG. 2 illustrates a schematic similar to that of FIG. 1, except that the ascending sector is not formed by a pipe but rather a reactor segment which is separated from the rest of the reactor contents by a wall.

Instead of a tube, the ascending sector can also be attained by having a separation wall subdivide the reactor into segments (see FIG. 2).

The tube or the separation wall does not close off with the reactor lid, but projects beyond the full level. The tube or separation wall is so far removed from the reactor bottom that the reactor contents are not hindered and can flow into the ascending sector without great turbulence.

The solids are drawn off on the bottom of the reactor, together with the quantity of the depolymerization product, which is to be conducted to a further processing. So that the sedimenting inert substances are removed as completely as possible from the reactor, the removal device for the depolymerization product is preferably situated in the lower area, in particular, on the bottom of the reactor.

In order to further support the most complete removal of the inert substances possible, the reactor is tapered downwards, preferably at the bottom, for example, tapering conically, or designed as an envelope of a cone standing on its point.

Figure 1:
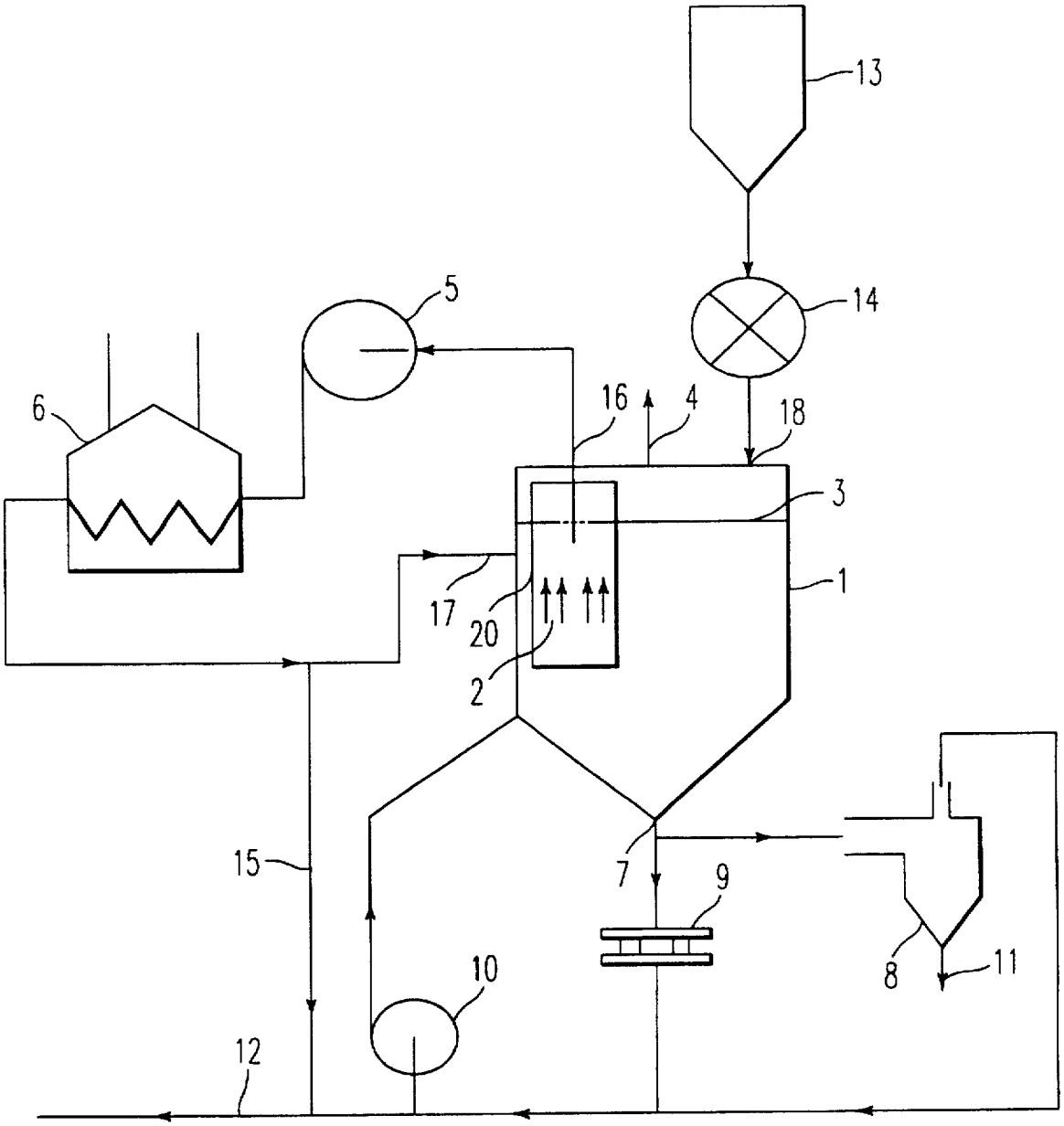
FIG. 1 illustrates a schematic embodiment of the present invention.

FIG. 1 shows such a device in the sense of an exemplified embodiment. Old and waste plastic is introduced into reactor (1) from a supply container (13) via a supply device (18) by means of a metering device (14) that closes in a gastight manner, for example, pneumatically. A bucket wheel sluice is very suitable, for example, as such a metering device. The depolymerization product, together with the contained inert substances, can be removed via device (7) on the bottom of the reactor. The addition of the plastic, as well as the removal of the depolymerization product, are advantageously carried out in a continuous manner and are designed in such a way that a certain level (3) of the reactor contents is approximately maintained. The formed gases and condensable products are removed from the head area of the reactor via device (4). The contents of the reactor are conducted to the gentle heating in the furnace/heat exchanger (6), using a pump (5), via a removal conduit (16) to the circulation system, and via a feed conduit (17), recirculated into reactor (1). Tube (20), which forms an ascending sector (2) for the reactor circulation flow, is situated in reactor (1).

The depolymerization product flow removed from the reactor is smaller than the circulation flow by a factor of 10 to 40. This depolymerization product flow is moved, for example, via a wet-grinding mill (9), so as to bring the inert components contained therein to a size admissible for further processing. The depolymerization product flow, however, can also be conducted via another separation device (8), where it is extensively freed of the inert components. Suitable separation devices are, for example, hydrocyclones or decanters. The inert components (11) can then be removed separately and, for example, supplied to a recycling. Alternatively, a part of the depolymerization product flow moved via the wet-grinding mill or via the separation device can be returned again to the reactor, using a pump (10). The other part is conducted to the recycling, for example, sump-phase hydrogenation, low-temperature carbonization, or gasification (12). A part of the depolymerization product can be removed directly from the circulation system via a conduit (15) and conducted to further processing.

FIG. 2 shows a reactor built similarly as in FIG. 1, with the difference that the ascending sector is not formed by a pipe, but rather by a reactor segment, which is separated from the rest of the reactor contents by a separation wall (19).

When using old and [waste] plastics from collections from households, the inert components (11) ejected via the separation device (8) consist mostly of aluminum, which, in this way, can be conducted to a material recycling. In addition, the ejection and recycling of aluminum open the possibility of also completely utilizing composite packaging materials. The utilization can take place together with plastic packaging materials. This offers the advantage that a separation of these packaging materials can be omitted. Composite packaging materials usually consist of paper or cardboard combined with a plastic and/or aluminum film. The plastic fraction is liquified in the reactor; the paper and the cardboard are broken down into primary fibers, which follow the liquid because of their low sedimentation tendency. The aluminum can be recovered to a large extent. Plastic and paper can be supplied to a raw-material utilization step after the depolymerization has been carried out.

Figure 3:
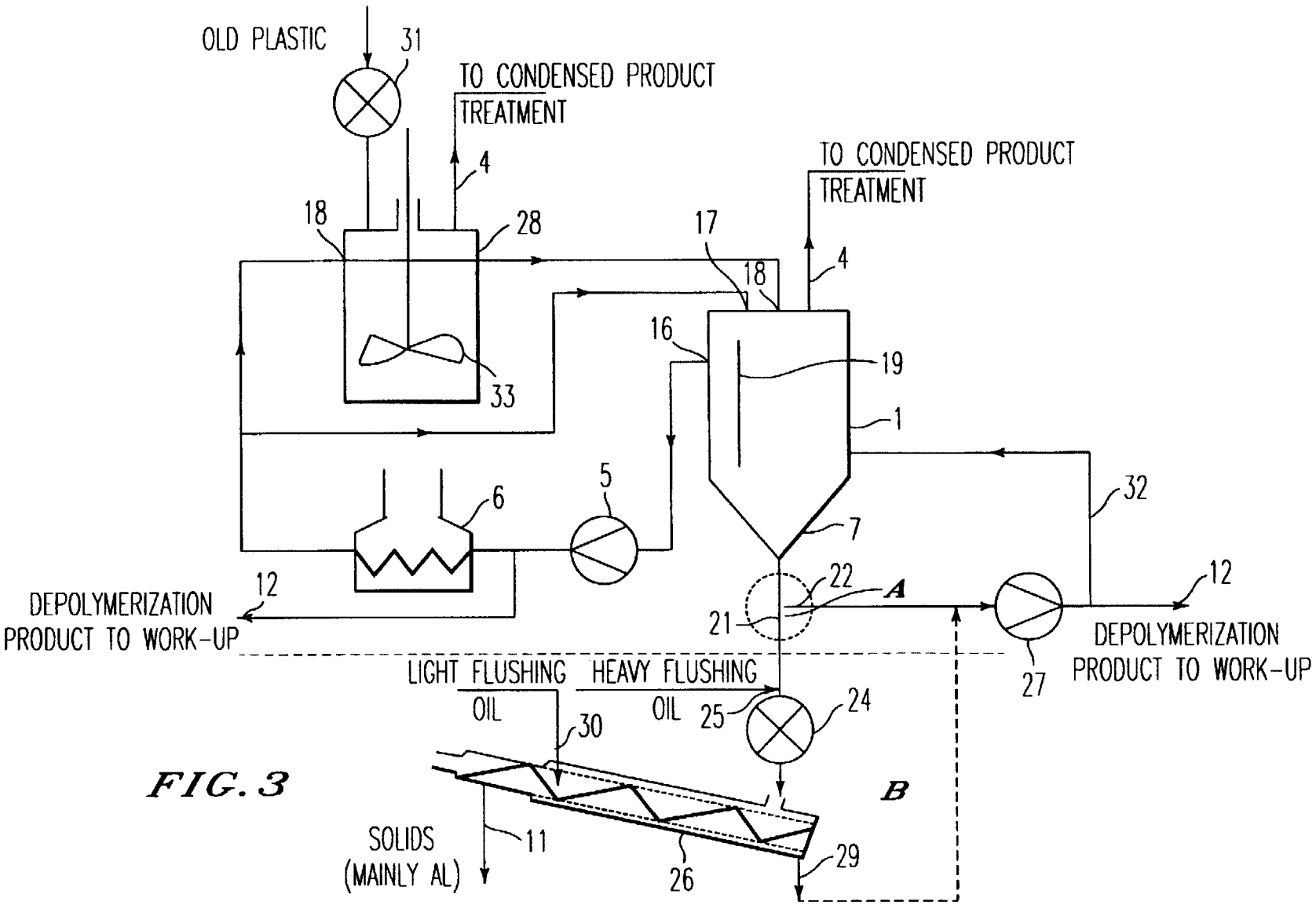
FIG. 3 illustrates a depolymerization unit of the present invention with two containers, which can be operated at different temperature levels.

FIG. 3 shows a depolymerization unit with two containers, which can be operated at different temperature levels. The first depolymerization container (28) is, for example, equipped with a stirrer (33), so as to be able to rapidly mix the old and waste plastics supplied via sluice (31) into the hot depolymerization product present. The second depolymerization container (1) downstream corresponds to the reactor from FIG. 1. The circulation to the gentle heating, essentially consisting of pump (5) and furnace/heat exchanger (6), is therefore low in solids. The depolymerization product, including the solid components, is removed at the bottom of the reactor. The quantitative solid/liquid ratio in the removal device (7) of the container (1) can be between 1:1 and 1:1000.

Preferably, the removal device (7) is a trap sector (21) with a branch (22), immediately downstream, placed essentially at right angles for this purpose.

The trap sector (21) and branch (22) can be designed as a T-shaped tube.

The branch can also be equipped with mechanical separation aids (23).

A flow of organic components of the depolymerization product, which are essentially liquid under the existing conditions, is conducted away via the branch (22). The depolymerization product arrives at the work-up unit via pump (27) or can also be returned to the reactor (1), at least partially, via conduit (32).

The quantity conducted away can be up to one thousand-fold that of the sluiced-out solids quantity. In the extreme case and perhaps temporarily, it is also possible that nothing will be conducted away via the branch (22). By specifying the depolymerization quantity drawn off via the branch (22), suitable flow ratios for the reliable discharge of the solids can be ensured. At the same time, the flow conducted away should be dimensioned in such a manner that solid particles are, if possible, not entrained to an appreciable extent. Preferably, the ratio of the sluiced-out solids quantity to the quantity conducted away is 1:50 and 1:200.

The trap sector (21) or the trap tube is equipped with a sluice (24) at the lower end in a special specific embodiment. A feed device (25) for flushing oil is installed above this sluice.

Figure 5:
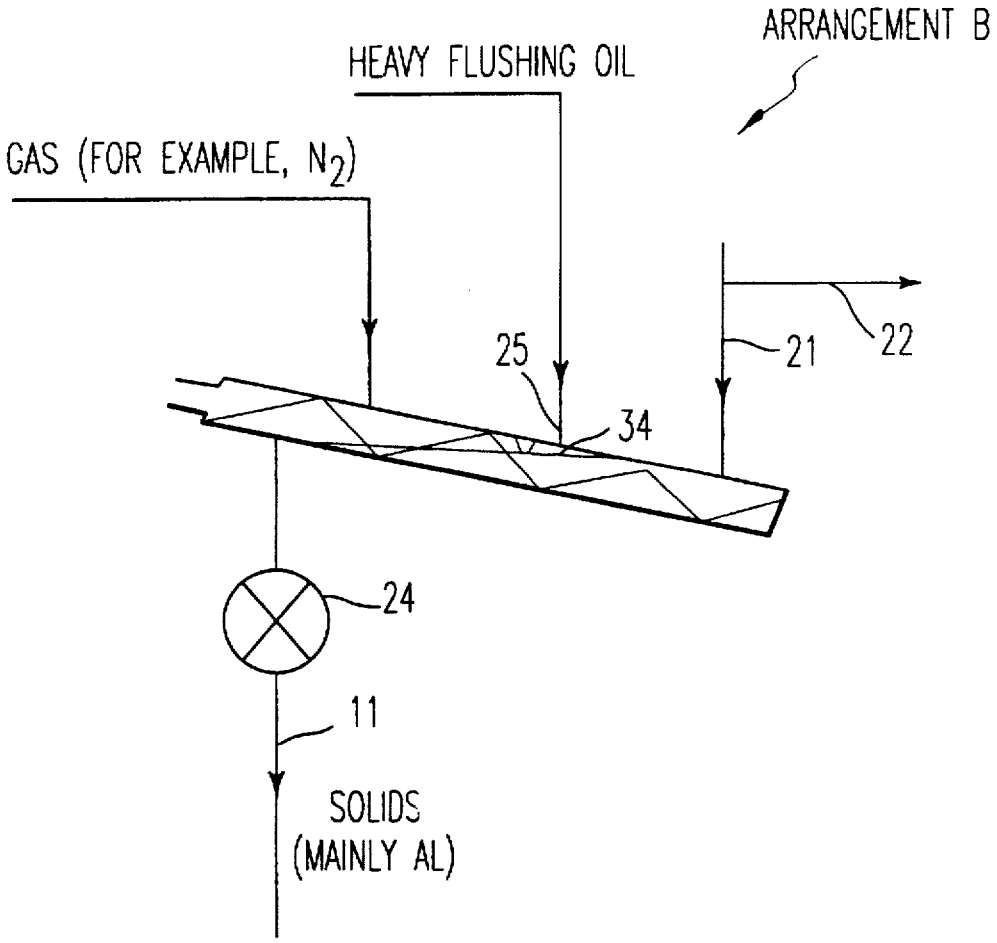
FIG. 5 illustrates a process-technological alternative, in which a separation device is connected directly downstream of the trap sector.

FIG. 5 shows a process-technological alternative, in which a separation device (26) is connected directly downstream to the trap sector (21). Preferably, a feed device (25) for flushing oil is installed on it.

Via the feed device (25), the flushing oil with a higher density than that of the depolymerization product is added in a quantity that produces a low flow rate of the liquid, then directed upwards within the trap sector between the feed device (25) and the branch (22). This makes it possible for the trap sector (21) or the trap tube to always be filled with relatively fresh flushing oil below the branch (22). A so-called stable layer with flushing oil is present in this part of the trap sector (21). If nothing is conducted away via the branch (22), the flushing oil ascends in the trap sector (21) and finally arrives at the reactor (1).

Whereas, preferably, the main quantity of the organic components of the depolymerization product is conducted away via the branch (22), the mostly inorganic solid particles, which are contained in the depolymerization product and which exhibit a sufficient sedimentation speed, pass the part of the trap sector (21) filled with flushing oil. To this end, the organic depolymerization product components still adhering to the solid particles are washed off or dissolved in the flushing oil.

The difference in the density between the depolymerization product and the flushing oil should be at least 0.1 g/mL, preferably 0.3 to 0.4 g/mL. The depolymerization product has a density of about 0.5 g/mL at a temperature of 400° C. As a suitable flushing oil, one can use, for example, a vacuum gas oil with a density of approximately 0.8 g/mL, heated to approximately 100° C.

The length of the trap sector (21) filled with flushing oil is dimensioned in such a way that the solid particles on the lower end of the trap sector (21) are at least extensively free of adhering organic depolymerization product components. It is also dependent on the type, composition, temperature, and the quantities of the depolymerization product put through and the flushing oil used. The specialist can determine the optimum length of the part of the trap sector (21) filled with flushing oil by relatively simple experiments.

As shown in FIG. 3, the solid particles are discharged with a part of the flushing oil via the sluice (24). Sluice (24) is used for the separation, according to the pressure, of the preceding and following unit parts. A bucket wheel sluice is preferably used. However, other types of sluices, such as timed cycle sluices, are suitable for this purpose. The discharged mixture has a solids content of approximately 40 to 60 wt %.

Appropriately, another separation device (26) for the separation of the flushing oil and solid particles follows sluice (24)

Advantageously, a drag conveyor or a screw conveyor is used as the separation device (26). They are directed upwards, at an incline, in the conveying direction. An angle to the horizontal plane of 30° to 60°, in particular, approximately 45°, is preferred.

FIG. 5 shows another method variant. Here, the solid particles pass through the separation device (26) immediately after passing the trap sector (21). A desired liquid level (34) is established in the separation device (26) via a gas cushion, for example, consisting of nitrogen, and the supply of flushing oil. The solid particles which, to a large extent, are freed of flushing oil are subsequently discharged via sluice (24), for example, a bucket wheel sluice or timed-cycle sluice.

A drainage screw (26), which can function as a suitable separation device, is schematically depicted in FIG. 3. A flushing oil with a lower density, for example, a middle distillate oil, can be provided via conduit (30). In this way, a heavier flushing oil is washed away from the solid particles. The low-viscous, light flushing oil can be at least extensively separated from the solid particles in a simpler way and without great difficulties. The spent flushing oil can be conducted away via conduit (29), or at least partially introduced into the depolymerization product conducted away via the branch (22). The separation device (26) preferentially works here under atmospheric conditions. The solid particles thus separated are discharged via conduit (11) and can be supplied to a recycling unit.

If plastics from collections from households are used as old and waste plastics, the solids discharged via conduit (11) consists mostly of metallic aluminum, which can be supplied to a subsequent material utilization step.

Figure 4:
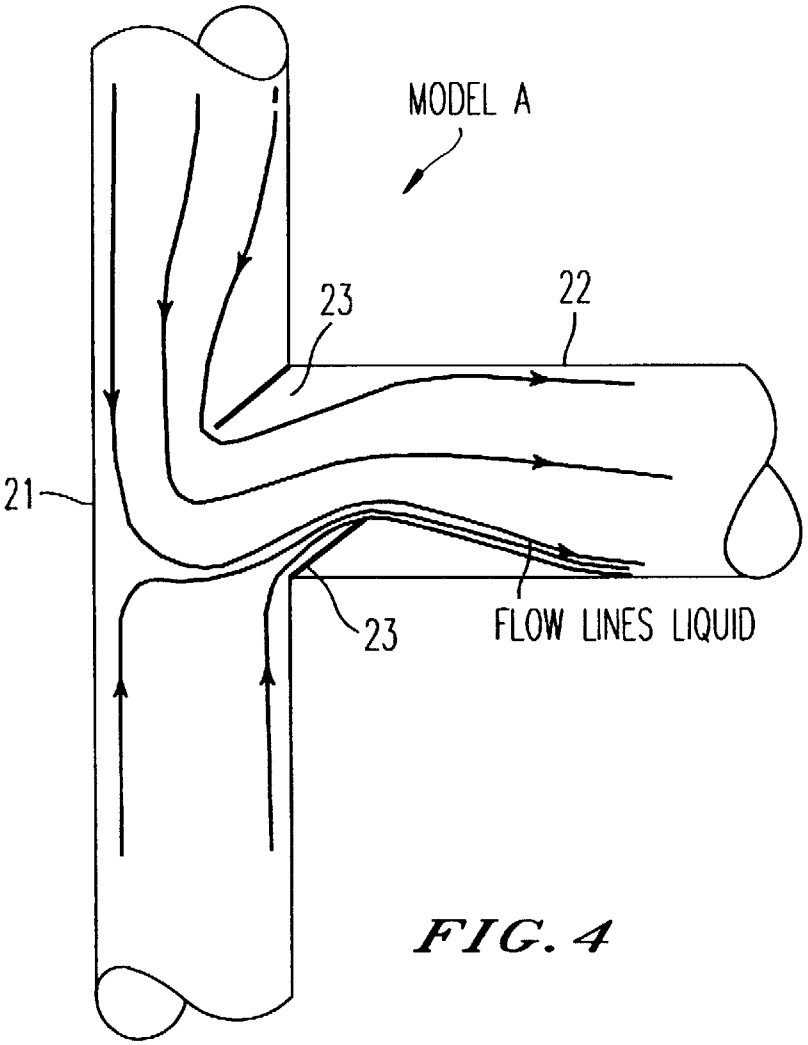
FIG. 4 illustrates, as a section enlargement of FIG. 3, a T-shaped arrangement of the trap sector and branch.

FIG. 4 shows, as a section enlargement of FIG. 3, the T-shaped arrangement of the trap sector (21) and branch (22). Likewise, mechanical separating aids (23) and the flow conditions, drawn in schematically with arrows, are depicted.

The depolymerization product is easy to handle after separation from the gas and condensed product, since it remains readily pumpable above 200° C. and in this form represents a good charge stock for the subsequent process stages and other utilization purposes.

The depolymerization product can, however, also be brought to solidification by means of a so-called cooling conveyor and thus can be turned into a solid form. For example, endless belts made of stainless steel are suitable. As a rule, they run by pull-over cylindrical guide drums or guide disks. The product can be supplied as a film in the front of the cooling conveyor, for example, by means of a broad-band nozzle. The lower side of the cooling conveyor is sprayed with a cooling liquid, wherein the product, however, is not wetted. By cooling the conveyor, the product on it also undergoes a lowering of the temperature and solidifies. In addition to the cooling from below, the depolymerization product can also be cooled from above by a supply of air. The solid film formed can be broken at the end of the cooling conveyor, for example, by means of a routing-crushing roller or by means of a grid-crushing roller. For the subsequent work-up or storage, it has also proved convenient if the fragments are not larger than the palm of a hand. Perhaps, the fragments can also be further comminuted, for example, ground.

The depolymerization product can be introduced, in pumpable form, directly into the subsequent process stages or can be supplied for other utilization purposes. If an intermediate storage is necessary, it should be done in tanks in which the depolymerization product is maintained at temperatures at which it can be easily pumped, generally at above 200° C. If a longer storage is desired, one possibility is to store the depolymerization product in solid form. In broken form, the depolymerization product can be transported, stored, and supplied to subsequent processes and utilizations analogous to the fossil fuel—mineral coal.

The invention under consideration concerns a method according to claims 1, 3, and 5, and concerns uses according to claims 7 and 8. Preferably, a depolymerization product is used, which is at least extensively free of coarse inorganic solid particles, in particular aluminum metal.

In the method of the invention according to claim 1, at least one partial flow of the depolymerization product, together with coal, is subjected to a coking. Not all types of coal are suited for the production of high-quality coke. Such a coke, for example, blast-furnace coke, should consist, as much as possible, of coarse pieces and should not be very pulverizable. It must have a minimum strength, so that a sufficient bed in a blast furnace can be attained, without the coke decomposing under the weight of the bed and, as a consequence, the blast furnace becoming clogged. Suitable types of coal are, for example, the caking fat coal of the Ruhr area or gas coal. Such caking coals are available in limited quantities and are more expensive, for example, than boiler coal.

Surprisingly, it was discovered that poorly caking coals form a cake during the coking process, if the depolymerization product is added to them. During the high-temperature coking process, which usually takes place at 900° to approximately 1400° C., with the exclusion of air, coking products with binder characteristics and which bring about a caking of the coal are apparently formed from the introduced depolymerization product. Something analogous is true also for the coking of brown coal for the production of semicoke, for example, in the open-hearth process. The desired effect of the caking is attained if the depolymerization product and coal are used in the ratio of 1:200 to 1:10. A range of 1:50 to 1:20 has proved to be particularly favorable.

In the method of the invention according to claim 3, at least one partial flow of the depolymerization product is subjected to a thermal utilization. "Thermal utilization" is understood to mean the oxidation of a substrate, utilizing the heat of reaction thereby formed. On the basis of its high energy content and its relatively low chlorine content, in comparison to old or waste plastics, with a simultaneously high homogeneity, the depolymerization product is a suitable fuel for use in power plants of all types and in cement plants. The depolymerization product can thereby be sprayed in as a liquid at temperatures above 200° C. via lances, for example, as a substitute for heavy heating oil, or can be introduced in solid form, for example, broken or ground.

In the method of the invention according to claim 5, at least one partial flow of the depolymerization product is used as a reducing agent in a blast furnace process. The depolymerization product can also be utilized here as a substitute for heavy heating oils, which are normally used for this purpose. Here, as in the thermal utilization, a relatively low content of chlorine of the depolymerization product of less than 0.5 wt % proves to be a particular advantage.

The depolymerization product can therefore be advantageously used as a binding additive in the coking of coal, as a reducing agent in blast furnace processes, and as fuel in furnaces, power plants, and cement plants.

Moreover, the depolymerization product can be used as a an additive to bitumen and bituminous products. Polymer-modified bitumens are used in many areas of the construction industry, especially in roof-sealing materials and in road construction. The characteristics of the bitumen, such as toughness, tensile strength, and wear capacity, are improved by the polymers contained in the depolymerization product. The depolymerization product undergoes chemical bonding during the joint heating with bitumen and bitumen derivatives because of its residual activity. This is, in part, the cause of the aforementioned and desired characteristic improvements.

By means of this modification, the cold flexibility as well as the stability of the bituminous material can be improved. An improvement of the elastic characteristics of the bitumen and the adhesion capacity on mineral filler material can also be attained by admixing polymers. The chemical reaction with bitumen has, moreover, the advantage that, for example, in hot storage, no segregation can take place or it is very limited. The residual activity of the depolymerization product can be enhanced by the introduction of functional groups, for example, according to the method of European Patent Applications Nos. 0,327,698, 0,436,803, and 0,537,638. Optionally, the bitumens or the bituminous products thus modified can also contain crosslinking agents (see European Patent No. 0,537,638 Al).

An addition of 1 to 20 parts by weight of the depolymerization product per 100 parts by weight of bitumen has proved to be practicable. An addition of 5 to 15 parts by weight of the depolymerization product per 100 parts by weight of bitumen is particularly favorable.

EXAMPLE 1

Depolymerization of old plastics

In a stirred-vessel reactor with a content of 80 $m^3$, provided with a circulation system having a capacity of 150 $m^3/h$, 5 t/h of mixed agglomerated plastic particles with an average particle diameter of 8 mm are pneumatically introduced. The mixed plastic is material that comes from the Dual System German (DSD) collection from households and typically contains 8% PVC.

The plastic mixture is depolymerized in a reactor at temperatures between 360° C. and 420°.

Four fractions are thereby formed; their quantitative distribution is summarized in the following table as a function of the reactor temperature.

| T [°C.] | I Gas [wt. %] | II Condensed Product [wt. %] | III Depolymerization Product wt. %] | IV HCl [wt. %] |
|---|---|---|---|---|
| 360 | 4 | 13 | 81 | 2 |
| 380 | 8 | 27 | 62 | 3 |
| 400 | 11 | 39 | 46 | 4 |
| 420 | 13 | 47 | 36 | 4 |

The depolymerization product flow (III) is continuously removed. The viscosity of the depolymerization product is 200 mpas at 175° C.

EXAMPLE 2

The depolymerization product from the processing of waste plastics from DSD collections from households according to Example 1 is admixed with coking coal in various quantitative ratios. The mixtures are coked in an experimental coking furnace.

Cokes are obtained with the characteristics described below:

| Experiment No. | 1 | 2 | 3 | 4 |
|---|---|---|---|---|
| Coal/Depolymerization | | | | |
| Ratio | 100:0 | 99:1 | 98:2 | 95:5 |
| CRI Index | 29 | 28 | 27 | 27 |
| CSR Index | 59 | 61 | 62 | 63 |
| Coke Strength M 40 (in %) | 73 | 76 | 77 | 78 |
| Coke Wear M 10 (in %) | 8 | 7 | 6 | 5 |

The values show that the addition of depolymerization product improves the coke strength (M 40) and reduces the wear tendency (M 10). Furthermore, the gasification reactivity (CRI index) is reduced, accompanied by an improved coke strength after gasification (CRI index) with the addition of depolymerization agent.

CRI: Coke Reaction Index

CSR: Coke Strength after Reaction Index

M 40: MICUM test 40

M 10: MICUM test 10

We claim:

1. A method for producing chemical raw materials and liquid fuel components from old or waste plastics, which comprises:

a) depolymerizing the old or waste plastics at an elevated temperature, optionally with the addition of a liquid auxiliary phase, a solvent, or a solvent mixture, thereby forming gaseous and condensable depolymerization products (condensed product) and a pumpable, viscous sump phase (depolymerization product); and b) removing said gaseous and condensable depolymerization products (condensed product) and said pumpable viscous sump phase (depolymerization product) in separate partial flows with the condensed product and depolymerization product being worked up, separately from one another;

wherein at least one partial flow of the depolymerization product is supplied to coal to be coked in order to provide an improved caking during coking.

2. The method of claim 1, wherein the depolymerization product and the coal are present in a ratio of about 1:200 to 1:10.

3. The method of claim 2, wherein said ratio is from about 1:50 to 1:20.

4. The method of claim 1, wherein at least one other said partial flow of the depolymerization product is subjected to oxidation.

5. The method of claim 4, wherein the oxidation of the depolymerization product is effected in a power plant or a cement plant.

6. The method of claim 1, wherein at least one other said partial flow of the depolymerization product is used as a reducing agent in a blast furnace process.

7. The method of claim 1, wherein the depolymerization product is used as a pumpable mass with a temperature above about 200° C. or as a solid.

8. The method of claim 1, wherein said elevated temperature is from about 150° to 470° C.

9. The method of claim 7, wherein said elevated temperature is from about 250° C. to 450° C.

10. The method of claim 1, which is effected at a pressure of from about 0.01 to 300 bar.

11. The method of claim 1, wherein a pressure of up to about 2 bar is used.

12. The method of claim 8, wherein the depolymerization product is ground or broken after cooling.

13. A method of fueling a furnace, power plant or cement plant, which comprises combusting a partial flow of the depolymerization product of claim 1.

14. A method of reducing raw materials in a blast furnace, which comprises adding a partial flow of the depolymerization product of claim 1 to said raw materials in said blast furnace.

15. A method of binding coal during coking thereof, which comprising adding the depolymerization product of claim 1 to said coal during coking, and then subjecting said and depolymerization product to said coking.

16. A method of enriching bitumen or a bituminous products or both, which comprises adding a partial flow of the depolymerization product of claim 1 to said bitumen or said bituminous product.

17. The method of claim 16, which comprises adding about 1 to 20 parts by weight of depolymerization product per about 100 parts by weight of bitumen.

18. The method of claim 17, wherein about 5 to 15 parts by weight of the depolymerization product is added per about 100 parts by weight of bitumen.

* * * * *